US005391451A

United States Patent [19]

Yoshie et al.

[11] Patent Number: 5,391,451

[45] Date of Patent: Feb. 21, 1995

[54] DEVELOPER COMPRISING TONER COMPOSED OF SPECIFIED RESIN AND CARRIER COATED WITH POLYOLEFINIC RESIN

[75] Inventors: Naoki Yoshie, Takatsuki; Junji Machida, Toyonaka; Masahiro Anno, Sakai; Makoto Kobayashi, Settsu, all of Japan

[73] Assignee: Minolta Camera Kabushiki Kaisha, Osaka, Japan

[21] Appl. No.: 9,763

[22] Filed: Jan. 27, 1993

[30] Foreign Application Priority Data

Jan. 29, 1992 [JP] Japan ..... 4-013703

[51] Int. Cl.[6] ..... G03G 9/083

[52] U.S. Cl. ..... 430/106.6; 430/108; 430/109

[58] Field of Search ..... 430/108, 110, 106, 109

[56] References Cited

U.S. PATENT DOCUMENTS 4,822,709 4/1989 Ohtani et al. ..... 430/106.6
5,093,201 3/1992 Ohtani et al. ..... 428/407
5,204,413 4/1993 Funato et al. ..... 430/109

FOREIGN PATENT DOCUMENTS 53-33151 3/1978 Japan .

*Primary Examiner*—John Goodrow
*Attorney, Agent, or Firm*—Burns, Doane, Swecker & Mathis

[57] ABSTRACT

The present invention relates to a developer for developing electrostatic latent images, which comprises:

a toner containing a binder resin being a thermoplastic resin composed of a copolymer of styrene and acrylic acid ester and/or methacrylic acid ester, with $6 \leqq \eta(110)/\eta(130) \leqq 25$ (where $\eta(110)$ represents the melting viscosity at 110° C., and $\eta(130)$ the same at 130° C.), and carbon black having pH 6 or above; and a carrier having its magnetic core coated with a polyolefinic resin, the carrier's core content being 94–99% by weight, the weight average molecular weight of the polyolefinic resin $5\times10^4$–$3\times10^5$ and the carrier's electric resistance $1\times10^7$–$1\times10^{12}$ Ω.cm, with 1–15% by weight of electrically conductive fine particles in proportion to the polyolefinic resin added thereto.

8 Claims, 1 Drawing Sheet

DEVELOPER COMPRISING TONER COMPOSED OF SPECIFIED RESIN AND CARRIER COATED WITH POLYOLEFINIC RESIN

BACKGROUND OF THE INVENTION

The present invention relates to a two-component developer. More particularly, it relates to a developer comprising a carrier coated with a polyolefinic resin and a toner which manifests a favorable positive chargeability in its friction against of the carrier.

Hitherto known as an electrophotographic electrostatic latent image developing system is the two component type developing system in which an insulating toner is frictionally electrified by mixing the toner with carrier particles and the developer is carried to the position where it is to come in contact and develop the electrostatic latent image.

The granular carrier used for such a two component developing system is normally coated with some appropriate material for the purposes of prevention of filming of the toner on the carrier surfaces, formation of uniform carrier surfaces, prevention of its surface oxidation, prevention of reduction in its sensitivity caused by humidity, prolongation of the life of the developer, protection of the photosensitive material from scratches or abrasion by the carrier, control of polarity of electrification and adjustment of the rate of electrification and so on.

Carriers on which polyolefinic resins are applied as such coating materials are known (e.g., Japanese Patent Laid-Open Publication No. Hei 1-7255).

The polyolefinic layer which appears in the aforementioned patent publication is formed by direct polymerization on the surface of the carrier core and is therefore excellent in adhesiveness to the core, causing no deterioration in the picture quality even when the copying is continued long, and excellent also in durability and resistance to the phenomenon of being spent.

On the other hand the toner, being the other element of the two-component developer, is a black toner having carbon black as a coloring agent added to and dispersed in mainly a thermoplastic resin. The carbon black added functions mainly as a coloring agent, but also plays the role of a charging controller, taking advantage of its conductivity. Therefore, the role of the carbon black as an additive is important; particularly, its dispersibility in the toner has a large bearing on the quality of the copied image and ease of use of the toner. Thus if the dispersibility of the carbon black in the toner is low, the toner will not be electrified uniformly. Such a toner tends to scatter, causing stained interior of a copying machine or fogs on the ground of the copied image. Further, if the dispersibility of the carbon black is low, as the copying is repeated, the amount of electrification of toner fluctuates, causing deteriorated quality of the copied image.

Further, to the toner, in general, a charging controller is added for adjusting the charging level and for ensuring the electrification stability. For toners to be positively charged, a positive charging controller such as Nigrosine dyes are used.

However, the polyolefinic resins themselves tend to be negatively electrified and therefore the toner will be positively charged in excess, depending on the positive charging controller used. But if the positive charging controller is to be used in smaller amount in order to lower the charging level, uniform dispersion of the positive charging controller into the toner will become difficult, resulting in insecurity in stable electrification, scattering of the toner and so forth.

Further, the charging controller exposed or sticking to the toner surface adheres to and accumulates on the carrier surface, due to the frictional contact between the carrier and the toner by dint of a long time stirring. As a result, the carrier's intrinsic electrification characteristic is impaired, resulting in insecurity in electrification and thereby causing scattering of the toner and the like. This phenomenon is also brought about by the toner spent to the carrier.

As described above, normally, the charging characteristic of a developer is largely influenced by the way of combination of the toner and the carrier, so that it needs to be examined on their individual combinations.

SUMMARY OF THE INVENTION

It is an object of the present invention to provide a developer which comprises a carrier coated with a polyolefinic resin and a toner suitable for use therewith, and which is capable of forming successful images free from scattering of the toner or other troubles without impairing chargeability for long.

Thus the present invention relates to a developer for developing electrostatic latent images, which comprises:

a toner containing a binder resin being a thermoplastic resin composed of a copolymer of styrene and acrylic acid ester and/or methacrylic acid ester, with $6 \leqq \eta(110)/\eta(130) \leqq 25$ (where $\eta(110)$ represents the melting viscosity at 110° C., and $\eta(130)$ the same at 130° C.), and carbon black having pH 6 or above; and a carrier having its magnetic core coated with a polyolefinic resin, the carrier's core content being 94–99% by weight, the weight average molecular weight of the polyolefinic resin $5\times10^4$–$3\times10^5$ and the carrier's electric resistance $1\times10^7$–$1\times10^{12}$ Ω.cm, with 1–15% by weight of electrically conductive fine particles in proportion to the polyolefinic resin added thereto.

DETAILED DESCRIPTION OF THE INVENTION

Figure 1:
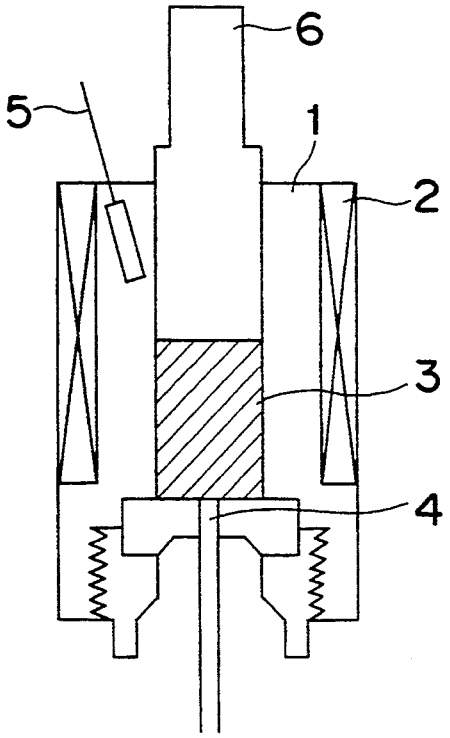
FIG. 1 is a diagram for explaining the method of measuring the melting viscosity.

The present invention provides a developer capable of forming successful images free from toner scattering or the like without impairing chargeability for long.

The object the present invention has been achieved by combining a toner composed of a specific binder resin and carbon black with the carrier coated with polyolefinic resin, without using any charging controller for the toner, whereas the charging controller has conventionally been added for controlling the chargeability of the toner.

The present invention relates to a developer for developing electrostatic latent images, which comprises:

a toner containing a binder resin being a thermoplastic resin composed of a copolymer of styrene and acrylic acid ester and/or methacrylic acid ester, with $6 \leqq \eta(110)/\eta(130) \leqq 25$ (where $\eta(110)$ represents the melting viscosity at 110° C. and $\eta(130)$ the same at 130° C.), and carbon black having pH 6 or above; and a carrier having its magnetic core coated with a polyolefinic resin, the carrier's core content being 94–99% by weight, the weight average molecular weight of the polyolefinic resin $5\times10^4$–$3\times10^5$ and the carrier's electric resistance $1\times10^7$–$1\times^{12}$ Ω.cm, with 1–15% by weight of electrically conductive fine particles in proportion to the polyolefinic resin added thereto.

The above-mentioned developer composed by combining a carrier coated with a polyolefinic resin and a toner is capable of forming successful images for long with the toner uniformly and stably electrified positively, without causing the toner to be spent and therefore without its scattering or the like, while making the most of the advantages that the carrier coated with the polyolefinic resin intrinsically has, such as the high durability, resistance to being spent and fluidity. Further, the developer will undergo less change in the amount of electrification even with environmental variations as in temperature and humidity.

First, the carrier composing the developer of this invention is explained.

The carrier of this invention is composed of carrier core particles coated on their surfaces with a polyolefinic resin.

In the following description of this specification, the term polyethylene is used as being representative of polyolefins, and carriers having a polyethylenic resin-coating layer are described.

As carrier core materials, those having a mean particle size of at least 20 μm shall be used for prevention of sticking (scattering) of the carrier onto the electrostatic latent image support and at most 100 μm from the standpoint of prevention of degradation in picture quality (for example, development of carrier streaks) and so forth. Actually applicable materials are those well-known as two component carriers in electrophotography including materials such as ferrite, magnetite, iron, nickel and cobalt; alloys or mixtures of these materials with zinc, antimony, aluminum, lead, tin, bismuth, beryllium, manganese, selenium, tungsten, zirconium, vanadium and other analogous metals; their mixtures with oxides of iron, titanium and magnesium and other analogous metal oxides, nitrides of chromium and vanadium and other analogous nitrides and carbides of silicon and tungsten and other analogous carbides; and ferromagnetic ferrite; and mixtures of these materials.

The surface of the carrier of this invention should desirably be coated with polyethylene resin 70% or more, preferably 90% or more and more preferably 95% or more. If the ratio of coating is less than 70%, the characteristics of the carrier core material's own (instability in environmental resistance, reduction in electric resistance and instability in electrification) strongly appear through their surface of carrier core itself, the resin coating being short of providing its advantageous effects.

The filling rate of the carrier core material should be set at 94–99% by weight, preferably 95–98% by weight. The filling rate may be regarded as one that indirectly specifies the resin-coating layer thickness of the carrier. If the carrier filling rate is smaller than 94% by weight, the coating layer is too thick, so that in actual developers such problems arise as stripping of the coating layer, increase in the amount of electrification and analogous phenomena inimical to the durability and charging stability, that are required of developers, or poor reproducibility of fine lines and lowered image density and analogous shortcomings in the picture quality.

The electric resistance of the polyethylene resin-coating layer of this invention should be set to about $1\times10^7$–$1\times10^{12}$ Ω.cm, preferably about $10^8$–$10^{10}$ Ω.cm. If the electric resistance is smaller than $1\times10^7$ Ω.cm, carrier is developed, with reduced picture quality. If it is larger than $1\times10^{12}$ Ω.cm, the toner is excessively electrified, resulting in failure to obtain proper image density. The electric resistance of the polyethylene resin-coating layer may be regarded as a property that indirectly expresses its coating rate and the carrier filling rate described above.

Some conductive fine particles may be added to the polyethylene-coating layer of the carrier of this invention.

There may be mentioned as such conductive fine particles various types of carbon black including carbon black, acetylene black and Ketchen Black; carbides including SiC, TiC, MoC and ZrC; and magnetic particles including ferrite and magnetite and so on.

The addition of carbon black has the effects of enhancing the developability and forming images with high density and vivid contrast. The addition of conductive fine grains such as carbon black is believed to cause moderate reduction in the carrier's electric resistance, whereby the leakage and accumulation of charges are properly balanced.

Excellence in the reproducibility of half-tone and the reproducibility of gradient tones may be mentioned as one of characteristics of the conventional binder type carriers. In the case of the coated carrier of this invention, a carrier excellent in the reproducibility of gradient tones may be obtained by adding magnetic powders to the polyethylene resin-coating layer. The addition of the magnetic particles to the polyethylene coating layer is believed to produce a surface composition similar to that of the binder type carriers, with its chargeability and specific gravity having approached to those of the binder type carriers.

The size of the additive and the amount of its addition are not particularly limited, so long as the carrier has satisfactory characteristics like irregularity, coating ratio and electric resistance, as required of the carrier of this invention. But concerning the size of the fine particles, as related to the preferred manufacturing methods of the carrier of this invention described later, it is proper that their particle sizes are such that they do not cohere in dehydrated hexane, for example, but uniformly disperse to form a slurry. Particularly, their mean particle size should be 2–0.01 μm, preferably about 1–0.01 μm.

The amount of the aforementioned fine particles can not be unconditionally prescribed as described above, but 1–15% by weight of the coated polyethylene resin is appropriate.

The manufacturing method of the carrier of this invention is not particularly limited, but any well-known methods are applicable. For example, the method which appears in Japanese Patent Laid-Open Publication No. Sho 60-106808 is suitable. The description in this publication is cited as a part of this Specification. Thus the polyethylene coating layer may be formed by polymerizing ethylene on the surface of the carrier core material, using (1) a product formed beforehand by subjecting the carrier core material to a catalytic treatment with a highly active catalyst component which contains titanium and/or zirconium and which is soluble in a hydrocarbon solvent and (2) an organic aluminum compound together therewith. Further, if the conductive fine particles are to be added, it is proper to add these additives, when forming the aforementioned polyethylene coating layer, to make them exist therein.

The method of forming polyethylene is to form the polyethylene coating layer directly on the surface of the carrier core material. The layer thus obtained is excellent in strength and durability. Particularly, when the weight average molecular weight of polyethylene is $5.0\times10^4$–$3.0\times10^5$, a polyethylene resin layer excellent in the strength of resin and its adhesion to the carrier can be formed, which is well-matched to the toner later-described.

For further enhancing the adhesiveness between the polyethylene resin layer and the carrier core material, the polymerization under such conditions as to have low molecular weights at the initial period of polymerization is effective.

The polyethylene coating layer formed in this way has a constitution having a finely irregular surface.

So long as the coating layer formed on the carrier surface meets the conditions of irregular structure, coating ratio, filling rate, electric resistance and so on, similarly as the polyethylene resin coating layer on the carrier surface as described above, this invention is equally applicable with other olefinic resins, for example, polypropylene.

In the following, the toner which composes the developer of this invention is explained.

The toner of this invention comprises at least: a thermoplastic resin formed by copolymerizing styrene and acrylic acid ester and/or methacrylic acid ester (hereinafter referred to as styrene-(meth)acrylic acid ester); and carbon black with its pH at 6 or higher.

According to this invention, by the combination of such carbon black and the above-mentioned binder resins, toners with high positive chargeability may be obtained without addition of charging additives. On this account, the toners obtained in this way are highly durable, involving no problem of deteriorated charging characteristics resulting from sticking of the charging controller to the carrier surface during its mixing with the carrier by stirring and therefore no problem of toner scattering and the like which would be triggered thereby.

There may be mentioned as styrenic monomers which compose styrene-(meth)acrylic acid esters, e.g., styrene, o-methyl styrene, m-methyl styrene, p-methyl styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, p-n-dodecyl styrene, p-methoxy styrene, p-phenyl styrene, p-chlorostyrene and 3,4-dichlorostyrene and derivatives thereof, among them styrene being most preferable.

There may be mentioned as acrylic monomers which compose styrene-(meth)acrylic acid ester copolymer resins, acrylic acid and its derivatives like methyl, ethyl, n-butyl, isobutyl, propyl, n-octyl, dodecyl, 2-ethyl hexyl, stearyl, 2-chloroethyl and phenyl acrylates and methyl $\alpha$-chloroacrylate; methacrylic acid and its derivatives like methyl, ethyl, propyl, n-butyl, isobutyl, n-octyl, dodecyl, 2-ethylhexyl, stearyl, phenyl, dimethylaminoethyl and diethylaminoethyl methacrylates; and (meth)acrylic acid derivatives like acrylonitrile, methacrylonitrile and acryl amide. Among these compounds, n-butyl methacrylate and n-butyl acrylate are preferable.

The melting viscosity $\eta(110)$ at 110° C. of the copolymer resins of this invention should be adjusted to $1\times10^6$–$2\times10^7$, preferably $2\times10^6$–$1\times10^7$ and more preferably $4\times10^6$–$8\times10^6$ poises. With the viscosity falling in this range, the thermal fixation may be made at high efficiency. If $\eta(110)$ is larger than $2\times10^7$ poises, the dispersibility of carbon black in the resin is low, and if smaller than $1\times10^6$ poises, such ill effects as offset and filming on the photosensitive material will occur.

The ratio of the melting viscosity $\eta(110)$ at 110° C. to the melting viscosity $\eta(130)$ at 130° C. of the copolymer resin of this invention should fall within the following range:

$$6\leqq\eta(110)/\eta(130)\leqq25$$

The adjustment of the melting viscosity within such a range permits the carbon black, a colorant, to be homogeneously dispersed into the binder resin, as a result making it possible to give the toner stable positive chargeability at a sharp distribution. If this melting viscosity ratio of $\eta(110)/\eta(130)$ falls outside the aforementioned range, it will be difficult to homogeneously disperse such an additive as carbon black, when preparing a toner by melting and kneading the binder resin with various additives, particularly carbon black, and the problem of toner scattering occurs due to reduction of charging amount under high humidity and widened distribution of the charging amount.

The melting viscosity according to this invention is represented by the value as measured by the following method.

This measuring method is now explained in reference to the accompanying drawing. A sample (3)(1.5 g) is charged into a cylinder (1) (cross-sectional area 1 $cm^2$) inside a heating unit (2), to heat it at a temperature-raising rate of 3° C./min. A piston is inserted into the cylinder and a load of 30 $kg/cm^2$ is applied, to make the sample flow out through a nozzle (4) (diameter 1 mm). Then the amount of the sample that has flowed out at that time, the falling distance of the piston and the temperature are measured. The temperature is detected by a temperature detector (5).

This measurement may be actually made using a falling type flow tester CFT-500 (made by Shimazu Seisakusho K.K.).

In the above-described method, the flow-down rate at each temperature was measured and the results were calculated by the following formula to give a viscosity at each temperature:

$$\text{Viscosity } \eta = \frac{\pi\cdot R^4\cdot P}{8\cdot L\cdot Q} \quad \text{(Poises)}$$

Where

R: Nozzle radius (0.5 cm)

P: Load (30 $kg/cm^2\rightarrow3.059\times10^{-4}$ Pa)

L: Nozzle length (0.1 cm)

Q: Flow (ml/sec)

$$Q = \frac{1.5\cdot S}{t}$$

Where

S: Sectional area of cylinder (1 $cm^2$)

t: Time taken by resin to fall down 1.5 cm (sec)

The carbon black to be contained in the toner of this invention should have a pH 6 or higher. By using such a carbon black, it is possible to stably charge the toner positively, with sharp distribution of charging amount of toner.

If the carbon black has a pH lower than 6.0, the carbon black's dispersion in the toner is heterogeneous. Then not only the quality of the developed image is deteriorated, but the charging amount of toner greatly fluctuates with repetitive copying.

The amount of carbon black used should be 0.1–15 parts by weight, preferably 0.5–10 parts by weight in proportion to 100 parts by weight of the aforementioned binder resin. If it is less than 0.1 parts by weight, the blackening degree of the toner image is short, but if it is more than 10 parts by weight, its sticking to the binder resin is weak, causing toner scattering and fogs on the image.

In the toner of this invention, a polyolefinic wax with a molecular weight of about $3\times10^3-1\times10^4$ may be further contained as a release agent. The addition of such a wax has the effect of preventing occurrence of offset. The amount of its addition should be 2–10 parts by weight, preferably 2–5 parts by weight in proportion to 100 parts by weight of the binder resin. The amount of its addition larger than 10 parts by weight will raise the problem of defective cleaning, filming on the photosensitive material and so forth, but that smaller than 2 parts by weight will facilitate offsetting, with the effect of the wax addition lost.

To the toner of this invention, a charging controller may be auxiliarily added in the range where it does not impair the effect of this invention. To meet this condition, the charging controller used should have weak chargeability and its amount added needs to be rather small.

As such a charging controller, quaternary ammonium salts or nitrogen-containing polymer resins may be used. As actual examples, those which appear in Japanese Patent Application Publication No. Hei 2-186694 may be mentioned.

Its amount to be used should be 5 parts by weight or less, preferably 3 parts by weight or less in proportion to 100 parts by weight of the aforementioned thermoplastic binder resin. If the amount of its addition exceeds 5 parts by weight, the charging amount is too high to have adequate image density.

The toner of this invention may have a fluidizer added (externally) and mixed therewith. As the fluidizer, there are available silica, aluminum oxide, titanium oxide, silica-aluminum oxide mixture, silica-titanium oxide mixture and so on, those made hydrophobic being preferable.

In preparing the toner of this invention, a composition formed by mixing the various components mentioned above is well mixed, then further mixed to make it adequately uniform, and thereafter kneaded, followed by cooling. This mixture is pulverized by a grinder such as a jet mill and classified to give a toner with 3 μ–30 μ particle sizes and a mean particle size of about 13 μ.

The present invention will be further described hereinbelow in connection with its embodiments.

Toner Manufacturing Example 1

| | Part by weight |
|---|---|
| Styrene-acrylic-copolymer resin | 100 |

-continued

| | Part by weight |
|---|---|
| Styrene/n-butyl methacrylate/n-butyl acrylate = 70:25:5<br>Flow tester melting viscosity:<br>$\eta(110) = 5.7\times10^6$, $\eta(130) = 4.0\times10^5$,<br>$\eta(110)/\eta(130) = 14$<br>Glass transition point: 60° C. | |
| Carbon black (Raben 1250)<br>(pH = 6.0, Particle size: 23 mμ, BET: 135 $m^2$) | 10 |
| Low molecular weight polypropylene resin (Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.5 parts by weight of a hydrophobic titanium oxidic fine particles (MT600BS, made by Teika K.K.) in proportion to 100 parts by weight of the fine particles were mixed therewith by Henschel mixer to give Toner A.

Toner Manufacturing Example 2

| | Part by weight |
|---|---|
| Styrene-acrylic copolymer resin<br>Styrene/n-butyl methacrylate/n-butyl acrylate = 80:5:15<br>Flow tester melting viscosity:<br>$\eta(110) = 4.8\times10^6$, $\eta(130) = 6.0\times10^5$,<br>$\eta(110)/\eta(130) = 8.0$<br>Glass transition point: 58° C. | 100 |
| Carbon black (Printex 55)<br>(pH = 10.0, Particle size: 25 mμ, BET: 110 $m^2/g$) | 10 |
| Low molecular weight polypropylene resin (Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.3 parts by weight of a hydrophobic alumina fine particles (RX-C, made by Nihon Aerosil K.K.) in proportion to 100 parts by weight of the fine particles were mixed therewith by Henschel mixer to give Toner B.

Toner Manufacturing Example 3

| | Part by weight |
|---|---|
| Styrene-acrylic copolymer resin<br>Styrene/n-butyl methacrylate/n-butyl acrylate = 75:20:5<br>Flow tester melting viscosity:<br>$\eta(110) = 7.4\times10^6$, $\eta(130) = 3.2\times10^5$,<br>$\eta(110)/\eta(130) = 23$<br>Glass transition point: 61° C. | 100 |
| Carbon black (Regal 330R)<br>(pH = 8.5, Particle size: 25 mμ, BET: 89 $m^2/g$) | 10 |
| Low molecular weight polypropylene resin (Viscol 550P (made by Sanyo Kasei Kogyo | 3 |

-continued

| | Part by weight |
|---|---|
| K.K.) | |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11μm. Then 0.2 parts by weight of a hydrophobic silica fine particles (RP130, made by Nihon Aerosil K.K.) in proportion to 100 parts by weight of the fine particles were mixed therewith by Henschel mixer to give Toner C.

Toner Manufacturing Example 4

| | Part by weight |
|---|---|
| Styrene-acrylic copolymer resin<br>Styrene/n-butyl methacrylate/n-butyl acrylate = 70:25:5<br>Flow tester melting viscosity:<br>$\eta(110) = 5.7 \times 10^6$, $\eta(130) = 4.0 \times 10^5$,<br>$\eta(110)/\eta(130) = 14$<br>Glass transition point: 60° C. | 100 |
| Carbon black (Raben 1250)<br>(pH = 6.0, Particle size: 23 mμ, BET: 135 $m^2/g$) | 10 |
| Low molecular weight polypropylene resin (Viscol 550P (made by Sanyo Kasei Kogyo K.K.)) | 3 |
| Quaternary ammonium salt (P-51) (made by Orient Kagaku Kogyo K.K.) | 1 |

The above-listed materials were well kneaded on three rolls heated to 140° C., after well mixed in a ball mill. After left to cool, this kneaded mixture was roughly pulverized using a feather mill and then further finely pulverized by a jet mill.

Next, the obtained particles were classified by the aid of a wind force to give fine particles with a mean particle size of 11 μm. Then 0.5 parts by weight of hydrophobic titanium oxidic fine particles (MT600BS, made by Teika K.K.) in proportion to 100 parts by weight of the fine particles were mixed therewith by Henschel mixer to give Toner D.

Toner Manufacturing Example 5

| | Part by weight |
|---|---|
| Styrene-acrylic copolymer resin<br>Styrene/n-butyl methacrylate/n-butyl acrylate = 70:25:5<br>Flow tester melting viscosity:<br>$\eta(110) = 5.7 \times 10^6$, $\eta(130) = 4.0 \times 10^5$,<br>$\eta(110)/\eta(130) = 14$<br>Glass transition point: 60° C. | 100 |
| Carbon black (MA#8, made by Mitsubishi Kasei K.K.)<br>(pH = 3.0, Particle size: 24 mμ, BET: 137 $m^2/g$) | 10 |
| Low molecular weight polypropylene resin (Viscol 550P (made by Sanyo Kasei Kogyo K.K.)) | 3 |
| Nigrosine (Nigrosine Base EX) | 1 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.5 parts by weight of hydrophobic titanium oxidic fine particles (MT600BS, made by Teika K.K.) in proportion to 100 parts by weight of the fine particles were mixed therewith by Henschel mixer to give Toner E.

Toner Manufacturing Example 6

| | Part by weight |
|---|---|
| Styrene-acrylic copolymer resin<br>Styrene/n-butyl methacrylate/n-butyl acrylate = 70:5:25<br>Flow tester melting viscosity:<br>$\eta(110) = 2.3 \times 10^6$, $\eta(130) = 8.3 \times 10^5$,<br>$\eta(110)/\eta(130) = 2.8$<br>Glass transition point: 57° C. | 100 |
| Carbon black (Raben 1250)<br>(pH = 6.0, Particle size: 23 mμ, BET: 135 $m^2/g$) | 8 |
| Low molecular weight polypropylene resin (Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.5 parts by weight of hydrophobic titanium oxidic fine particles (MT600BS, made by Teika K.K.) in proportion to 100 parts by weight of the fine particles were mixed therewith by Henschel mixer to give Toner F.

Toner Manufacturing Example 7

| | Part by weight |
|---|---|
| Styrene-acrylic copolymer resin<br>Styrene/n-butyl methacrylate/n-butyl acrylate = 85:12:3<br>Flow tester melting viscosity:<br>$\eta(110) = 9.0 \times 10^6$, $\eta(130) = 2.5 \times 10^5$,<br>$\eta(110)/\eta(130) = 36$<br>Glass transition point: 70° C. | 100 |
| Carbon black (Raben 1250)<br>(pH = 6.0, Particle size: 23 mμ, BET: 135 $m^2/g$) | 10 |
| Low molecular weight polypropylene resin (Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.5 parts by weight of hydrophobic titanium oxidic fine particles (MT600BS, made by Teika K.K.) in proportion to 100 parts by weight of the fine particles were mixed therewith by Henschel mixer to give Toner G.

Toner Manufacturing Example 8

| | Part by weight |
|---|---|
| Styrene-acrylic copolymer resin<br>Styrene/n-butyl methacrylate/n-butyl acrylate = 70:25:5<br>Flow tester melting viscosity:<br>$\eta(110) = 5.7 \times 10^6$, $\eta(130) = 4.0 \times 10^5$,<br>$\eta(110)/\eta(130) = 14$<br>Glass transition point: 60° C. | 100 |
| Carbon black (Mogul L)<br>(pH = 3.0, Particle size: 24 mμ, BET: 138 $m^2/g$) | 10 |
| Low molecular weight polypropylene resin<br>(Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.5 parts by weight of hydrophobic titanium oxidic fine particles (MT600BS, made by Teika K.K.) in proportion to 100 parts by weight of the fine particles were mixed therewith by Henschel mixer to give Toner H.

Toner Manufacturing Example 9

| | Part by weight |
|---|---|
| Styrene-acrylic copolymer resin<br>Styrene/n-butyl methacrylate/n-butyl acrylate = 70:15:15<br>Flow tester melting viscosity:<br>$\eta(110) = 5.7 \times 10^6$, $\eta(130) = 4.0 \times 10^5$,<br>$\eta(110)/\eta(130) = 10$<br>Glass transition point: 60° C. | 100 |
| Carbon black (Raben 1250)<br>(pH = 6.0, Particle size: 23 mμ, BET: 135 $m^2/g$) | 10 |
| Nitrogen-containing polymer<br>(A-1, made by Arakawa Kagaku Kogyo K.K.) | 2 |
| Low molecular weight polypropylene resin<br>(Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.5 parts by weight of hydrophobic titanium oxidic fine particles (MT600BS, made by Teika K.K.) in proportion to 100 parts by weight of the fine particles were mixed therewith by Henschel mixer to give Toner I.

Toner Manufacturing Example 10

| | Part by weight |
|---|---|
| Styrene-acrylic copolymer resin<br>Styrene/n-butyl methacrylate/n-butyl acrylate = 70:20:10<br>Flow tester melting viscosity:<br>$\eta(110) = 4.8 \times 10^6$, $\eta(130) = 6.0 \times 10^5$,<br>$\eta(110)/\eta(130) = 8.0$<br>Glass transition point: 62° C. | 100 |
| Nitrogen-containing polymer | 2 |

-continued

| | Part by weight |
|---|---|
| (A-1, made by Arakawa Kagaku Kogyo K.K.) | |
| Carbon black (Printex 55)<br>(pH = 10.0, Particle size: 25 mμ, BET: 110 $m^2/g$) | 10 |
| Low molecular weight polypropylene resin<br>(Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.3 parts by weight of hydrophobic alumina fine particles (RX-C, made by Nihon Aerosil K.K.) in proportion to 100 parts by weight of the fine particles were mixed therewith by Henschel mixer to give Toner J.

Toner Manufacturing Example 11

| | Part by weight |
|---|---|
| Styrene-acrylic copolymer resin<br>Styrene/n-butyl methacrylate/n-butyl acrylate = 75:20:5<br>Flow tester melting viscosity:<br>$\eta(110) = 7.4 \times 10^6$, $\eta(130) = 3.2 \times 10^5$,<br>$\eta(110)/\eta(130) = 23$<br>Glass transition point: 61° C. | 100 |
| N,N'-Dimethyl aminoethyl methacrylate | 2 |
| Carbon black (Raben 1250)<br>(pH = 6.0, Particle size: 23 mμ, BET: 135 $m^2/g$) | 10 |
| Low molecular weight polypropylene resin<br>(Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.2 parts by weight of hydrophobic silica fine particles (RP130, made by Nihon Aerosil K.K.) in proportion to 100 parts by weight of the fine particles were mixed therewith by Henschel mixer to give Toner K.

Toner Manufacturing Example 12

| | Part by weight |
|---|---|
| Styrene-acrylic copolymer resin<br>Styrene/n-butyl methacrylate/n-butyl acrylate = 70:10:20<br>Flow tester melting viscosity:<br>$\eta(110) = 2.3 \times 10^6$, $\eta(130) = 8.3 \times 10^5$,<br>$\eta(110)/\eta(130) = 2.8$<br>Glass transition point: 63° C. | 100 |
| Carbon black (Raben 1250)<br>(pH = 6.0, Particle size: 23 mμ, BET: 135 $m^2/g$) | 10 |
| Nitrogen-containing polymer<br>(A-1, made by Arakawa Kagaku Kogyo K.K.) | 2 |
| Low molecular weight polypropylene resin<br>(Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.5 parts by weight of hydrophobic titanium oxidic fine particles (MT600BS, made by Teika K.K.) in proportion to 100 parts by weight of the fine particles were mixed therewith by Henschel mixer to give Toner L.

Toner Manufacturing Example 13

| | Part by weight |
|---|---|
| Styrene-acrylic copolymer resin<br>Styrene/n-butyl methacrylate/n-butyl acrylate = 85:10:5<br>Flow tester melting viscosity:<br>$\eta(110) = 9.0 \times 10^6$, $\eta(130) = 2.5 \times 10^5$,<br>$\eta(110)/\eta(130) = 36$<br>Glass transition point: 64° C. | 100 |
| Carbon black (Raben 1250)<br>(pH = 6.0, Particle size: 23 mμ, BET: 135 $m^2/g$) | 10 |
| Nitrogen-containing polymer<br>(A-1, made by Arakawa Kagaku Kogyo K.K.) | 2 |
| Low molecular weight polypropylene resin<br>(Viscol 550P (made by Sanyo Kasei Kogyo K.K.)) | 3 |

The above-listed materials were well kneaded on three rolls heated to 140° C., after well mixed in a ball mill. After left to cool, this kneaded mixture was roughly pulverized using a feather mill, and then further finely pulverized by a jet mill.

Next, the obtained particles were classified by the aid of a wind force to give fine particles with a mean particle size of 11 μm. Then 0.5 parts by weight of hydrophobic titanium oxidic fine particles (MT600BS, made by Teika K.K.) in proportion to 100 parts by weight of the fine particles were mixed therewith by Henschel mixer to give Toner M.

Carrier Manufacturing Example 1

Into a 500 ml capacity flask with its inside air replaced by argon, 200 ml of n-heptane dehydrated at room temperature and 15 g (25 mmole) of magnesium stearate preliminarily dehydrated under a reduced pressure (2 mmHg) at 120° C. were put, to be made a slurry. After 0.44 g (2.3 mmole) of titanium tetrachloride was added dropwise while stirring, its temperature raise was started, and then the reaction was allowed to proceed for 1 hr under refluxing conditions, yielding a sticky and transparent solution of a titanium-containing catalyst component.

Into a 1 liter capacity autoclave with its inside air replaced by argon, 500 ml of hexane dehydrated at room temperature and 450 g of a sintered ferrite particles F-300H (made by Nihon Teppun K.K., mean particle size 60 μm) dried at 200° C. for 3 hr under a reduced pressure (2 mmHg) were put and their stirring was started. The temperature in the autoclave was raised up to 40° C. and then 0.02 mmole in terms of titanium atom of the aforementioned titanium-containing catalyst component was added for polymerization for about 1 hr. Thereafter, 0.44 g of carbon black (Ketchen Black EC, made by Lion Akuzo K.K.) was charged into the autoclave through its top nozzle. The carbon black used had been prepared in a slurry form by mixing with dehydrated hexane its powder dried under a reduced pressure at 200° C. for 1 hr. Subsequently, 2.0 mmole of triethyl aluminum and 2.0 mmole of diethyl aluminum chloride were added and the temperature of the system was raised to 90° C. At this time, the in-system pressure was 1.5 $kg/cm^2G$. Next, the pressure was raised to 2 $kg/cm^2G$ by feeding hydrogen thereinto. Then while continuously feeding ethylene thereinto at such a rate as to hold the total pressure at 6 $kg/cm^2G$, its polymerization was carried out for 58 min, yielding 476 g in total of a ferrite and carbon black-containing ethylene composition. Its dried particles were colored uniformly black and it was observed under an electron microscope that the ferrite surface was thinly coated with polyethylene and that carbon black was uniformly dispersed in the polyethylene. When this composition was measured by TCA (a thermal balance), the ferrite and the carbon black weighed 95.8% by weight in total (Carrier I).

Carrier Manufacturing Example 2

An acrylic resin solution (Acrydick A405, made by Dainihon Ink K.K.) with a 2% solid ratio was used as a coating solution, and sintered ferrite particles (F-200, made by Powdertech K.K, with a 70 μm volume average particle size) as the core material. The former was applied on the latter by use of Spiller Coater (made by Okada Seiko K.K.) so as to form a coating of 1.0% by weight of the core material. Thereafter, the temperature inside the system was raised to 150° C., to set the resin, yielding a thermosetting acrylic resin-coated carrier. The core material filling rate of the carrier thus obtained was 99.0% by weight (Carrier II).

With a toner concentration of 5% by weight, in such combinations of toners and carriers as listed in Table 1 below, the charging amount and the amount of scattered toner at the initial stage and the charging amount and the amount of scattered toner after 100,000 times of copy were measured. As a copying machine, Minolta EP-4300 was used. The amount of scattered toner is represented by the amount of toner (mg/K) which has accumulated on the opening of the developing machine for every 1000 sheets of paper. The results of evaluation are given in Table 2.

For evaluation of the amount of scattered toner in Table 2, the symbol "◎" means that the amount of toner is less than 2 mg. The symbol "○" means that the amount of toner is within the range between 2 and 10 mg. The symbol "Δ" means that the amount of toner is within the range between 10 and 50 mg. The symbol "×" signifies that the amount of toner is more than 50 mg.

TABLE 1

| Example | Toner | Carrier | Comparative Example | Toner | Carrier |
|---|---|---|---|---|---|
| 1 | A | I | 1 | F | I |
| 2 | B | I | 2 | G | I |
| 3 | C | I | 3 | H | I |
| 4 | D | I | 4 | A | II |
| 5 | I | I | 5 | E | I |
| 6 | J | I | 6 | L | I |
| 7 | K | I | 7 | M | I |
| 8 | | | 8 | I | II |

TABLE 2

| | Initial | | After 10,000 times of copy | | After 100,000 times of copy | |
|---|---|---|---|---|---|---|
| | Charging amount | Scattering | Charging rate | Scattering | Charging rate | Scattering |
| Example | | | | | | |
| 1 | 11 | ∘ | 10 | ∘ | 9 | ∘ |
| 2 | 12 | ∘ | 10 | ∘ | 10 | ∘ |
| 3 | 11 | ∘ | 11 | ∘ | 10 | ∘ |
| 4 | 15 | ∘ | 13 | ∘ | 13 | ∘ |
| 5 | 18 | ∘ | 17 | ∘ | 16 | ∘ |
| 6 | 19 | ∘ | 19 | ∘ | 17 | ∘ |
| 7 | 17 | ∘ | 16 | ∘ | 16 | ∘ |
| Comp. Example | | | | | | |
| 1 | 9 | Δ | 7 | x | The plate wear test uncontinuable. | |
| 2 | 8 | Δ | 6 | x | | |
| 3 | 5 | xx | 3 | xx | | |
| 4 | 4 | xx | 3 | xx | | |
| 5 | 30 | ∘ | 12 | ∘ | 8 | x |
| 6 | 16 | Δ | 14 | Δ | 13 | x |
| 7 | 16 | Δ | 13 | x | 11 | x |
| 8 | 10 | x | 8 | x | →The plate wear test uncontinuable. | |

As is obvious from the table above, the developers embodying this invention gave excellent electrification-build-up properties even at relatively low charging amounts and low amount of scattered toner and had excellent durability.

What is claimed is:

1. A developer for developing electrostatic latent images, which comprises:

a toner containing a binder resin being a thermoplastic resin composed of a copolymer of styrene and acrylic acid ester and/or methacrylic acid ester, with $6 \leqq \eta(110)/\eta(130) \leqq 25$ (where $\eta(110)$ represents the melting viscosity at 110° C., and $\eta(130)$ the same at 130° C.), and carbon black having pH 6 or above; and a carrier having its magnetic core coated with a polyolefinic resin, the carrier's core content being 94–99% by weight, the weight average molecular weight of the polyolefinic resin $5\times10^4$–$3\times10^5$ and the carrier's electric resistance $1\times10^7$–$1\times^{12}$ Ω.cm, with 1–15% by weight of electrically conductive fine particles in proportion to the polyolefinic resin added thereto.

2. The developer according to claim 1, wherein the toner contains 0.1–15 parts by weight of the carbon black on the basis of 100 parts by weight of the binder resin.

3. The developer according to claim 1, wherein the toner contains a polyolefinic wax with its molecular weight ranging from $3\times10^3$–$1\times10^4$.

4. The developer according to claim 3, wherein the amount of the wax added is 2–10 parts by weight in proportion to 100 parts by weight of the binder resin.

5. The developer according to claim 1, wherein to the toner is added and mixed therewith at least one fluidizer selected from the group consisting of silica, aluminum oxide, titanium oxide, a mixture of silica and aluminum oxide, and a mixture of silica and titanium oxide.

6. The developer according to claim 5, wherein the fluidizer is treated to be hydrophobic.

7. The developer according to claim 1, wherein the melting viscosity of the thermoplastic resin at 110° C. is within the range between $1\times10^6$ and $2\times10^7$ poises.

8. A developer for developing electrostatic latent images, which comprises:

a toner containing a binder resin being a thermoplastic resin composed of a copolymer of styrene and acrylic acid ester and/or methacrylic acid ester, with $6 \leqq \eta(110)/\eta(130) \leqq 25$ (where $\eta(110)$ represents the melting viscosity at 110° C., and $\eta(130)$ the same at 130° C.), and nigrosine-free carbon black having pH 6 or above; and a carrier having its magnetic core coated with a polyolefinic resin, the carrier's core content being 94–99% by weight, the weight average molecular weight of the polyolefinic resin $5\times10^4$–$3\times10^5$ and the carrier's electric resistance $1\times10^7$–$1\times10^{12}$ Ω.cm, with 1–15% by weight of electrically conductive fine particles in proportion to the polyolefinic resin added thereto.

* * * * *